US005136902A

United States Patent [19]

Ma

[11] Patent Number: 5,136,902

[45] Date of Patent: Aug. 11, 1992

[54] MULTIPLE USE WRENCH

[76] Inventor: Homer W. Ma, 1809 Happ Rd., Northbrook, Ill. 60062

[21] Appl. No.: 646,563

[22] Filed: Aug. 31, 1984

Related U.S. Application Data

[63] Continuation-in-part of Ser. No. 431,569, Sep. 30, 1982, abandoned.

[51] Int. Cl.[5] ..... B25B 13/08

[52] U.S. Cl. ..... 81/119; 81/125.1

[58] Field of Search ..... 81/119, 125.1, 186

[56] References Cited

U.S. PATENT DOCUMENTS

| | | | |
|---|---|---|---|
| 3,745,859 | 7/1973 | Evans et al. | 81/119 |
| 3,850,057 | 11/1974 | Evans | 81/119 |
| 3,858,464 | 1/1975 | Evans | 81/119 |
| 3,875,828 | 4/1975 | Evans | 81/119 |
| 3,881,377 | 5/1975 | Evans et al. | 81/186 |
| 3,921,476 | 11/1975 | Evans | 81/119 |
| 3,931,749 | 1/1976 | Evans | 81/119 |
| 3,955,450 | 5/1976 | Evans | 81/186 |

*Primary Examiner*—D. S. Meislin

*Attorney, Agent, or Firm*—Fitch, Even, Tabin & Flannery

[57] ABSTRACT

A multiple use wrench for use with a hex shaped head with equal hex head sides of a first predetermined length and a square shaped head with equal square head sides of a second predetermined length, where the distance between parallel sides of the hex shaped head is equal to the distance between parallel sides of the square shaped head, including a handle, a drive end attached at one end of the handle, the drive end having a portion suitable for driving the hex shaped and square shaped heads which include seven adjacent sides which are connected in order from a first side to a second side to a third side to a fourth side to a fifth side to a sixth side and to a seventh side, the first side having a length suitable for driving the square shaped head, the second side adjacent to the first side and having a length less than the length of a hex head side, the third side adjacent to the second side, forming an angle of substantially 120° therewith, and having a length substantially equal to the length of a hex head side, the fourth side adjacent to the third side, forming an angle of substantially 120° therewith, and having a length substantially equal to the length of a hex head side, the fifth side adjacent to the fourth side, forming an angle of substantially 120° therewith, the fifth side being substantially parallel to the second side, and having a length greater than or equal to the length of a hex head side plus the length of the second side, the sixth side adjacent to the fifth side, forming an angle of substantially 120° therewith, the sixth side being substantially parallel to the third side and the seventh side adjacent to the sixth side, the seventh side being substantially parallel to the first side, having a length equal to or greater than the length of the hex head sides of the first predetermined length, and being displaced from the first side by a distance substantially equal to the distance between parallel sides of the square shaped head of the second predetermined side.

12 Claims, 2 Drawing Sheets

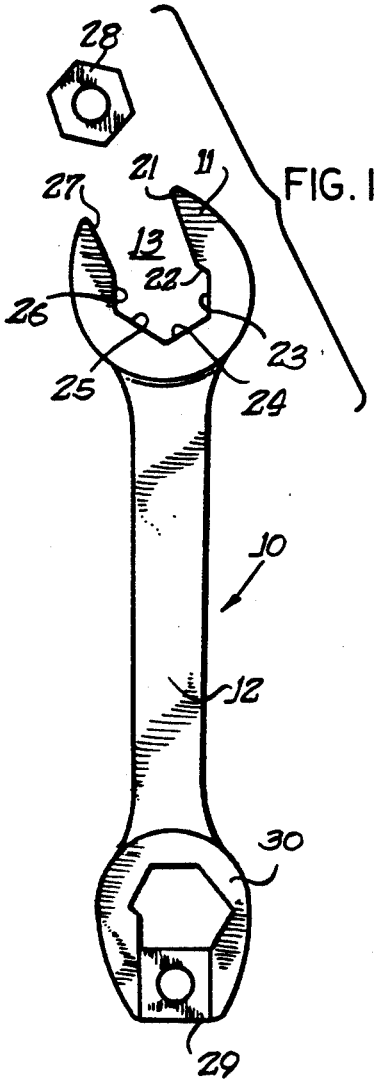
FIG. 1
FIG. 2
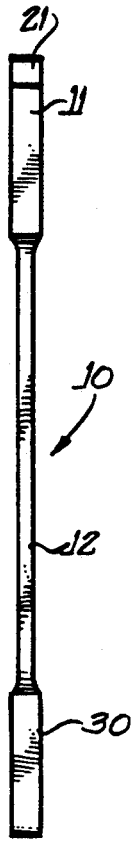
FIG. 3
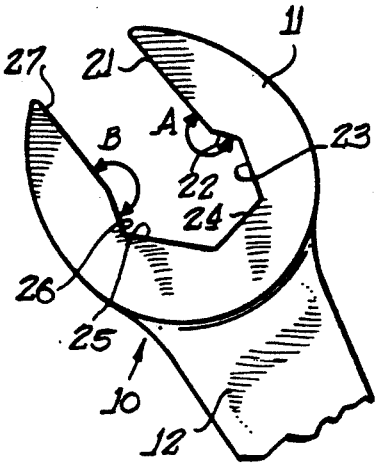
FIG. 4
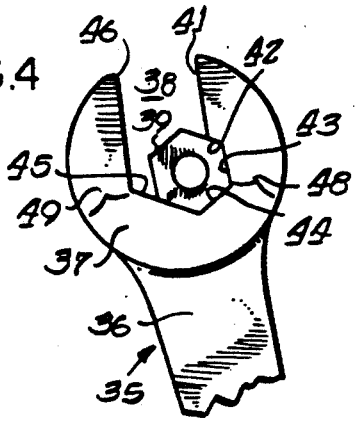

MULTIPLE USE WRENCH

BACKGROUND OF THE INVENTION

This application is a continuation-in-part of my application Ser. No. 431,569 filed Sep. 30, 1982, and entitled "Multiple Use Wrench", now abandoned, which is incorporated herein by reference.

This invention generally relates to wrenches and more particularly concerns a wrench which has multiple uses in that it can perform the functions of an open end or box end wrench as well as a ratchet wrench.

In the past many single purpose tools have been developed including open end wrenches which may be adjustable or non-adjustable as to the distance between the sides of the open end and the types of heads that can be turned. In turning a head with an open end wrench the entire wrench will rotate around the axis of the head and considerable angular movement is required to turn the head. This is further complicated when operating space is restricted. Then the operation becomes quite time consuming as an open end wrench has to be disengaged from the head and engaged to the head every time the restricted angular movement is reached. To engage or disengage an open end wrench the wrench must either be lifted or lowered from the head or pulled back and pushed toward the head.

Closed end or box wrenches have the same difficulties as an open end wrench in that when space is restricted they must be lifted to disengage the head and then lowered to engage the head each time the restriction on angular movement is reached in order to further drive it. Considerable repetitions of these movements must be made in order to turn the head.

In the past, open end wrenches have been used to turn square shaped heads of nuts, bolts or the like and box wrenches have usually been used to turn hex shaped heads of nuts, bolts and the like. A further disadvantage of a box wrench is that it cannot be used to turn a nut or bolt if the fitting or pipes have been installed or joined to form a loop.

To alleviate some of these problems of the fixed wrenches described above, a series of ratchet type wrenches have been developed which usually comprise a handle with a ratchet and a series of sockets to fit different types of heads. While this has helped considerably in being able to fasten a head or turn a head where restricted angular movement is possible, it has the disadvantage of requiring that the head of the nut, bolt, fitting or the like must be reachable from the end and cannot be used for objects like pipes that have already been installed or joined to form a closed loop. Moreover, ratchet wrenches have the disadvantage of several moving parts which can wear and lead to break down or failure.

Accordingly, it is the object of this invention to provide a wrench which performs the operations of an open end wrench, a box end wrench, and a ratchet wrench.

A further object of this invention is to provide a wrench that will be applicable for use with either a hex shaped head or a square shaped head where the distance between parallel sides of each of said heads is equal.

Still another object of this invention is to provide a fixed end wrench which will perform and handle like a ratchet wrench for hex heads with no moving parts.

A final object of this invention is to provide an adjustable wrench which will accomplish all of the objects above and additionally allow use with several different head widths.

SUMMARY OF THE INVENTION

In accordance with the invention, a multiple use wrench is provided for use with a hex shaped head with equal hex head sides of a first predetermined length and a square shaped head with equal square head sides of a second predetermined length where the distance between parallel sides of the hex shaped head is equal to the distance between parallel sides of the square shaped head, including a handle, a drive end attached at one end of the handle, the drive end having a portion suitable for driving the hex shaped and square shaped heads which include seven adjacent sides which are connected in order to form a first side to a second side to a third side to a fourth side to a fifth side to a sixth side and to a seventh side, the first side having a length suitable for driving the square shaped head, the second side adjacent to the first side and having a length less than the length of a hex head side, the third side adjacent to the second side, forming an angle of substantially 120° therewith, and having a length substantially equal to the length of a hex head side, the fourth side adjacent to the third side, forming an angle of substantially 120° therewith, and having a length substantially equal to the length of a hex head side, the fifth side adjacent to the fourth side, forming an angle of substantially 120° therewith, the fifth side being substantially parallel to the second side, and having a length greater than or equal to the length of a hex head side plus the length of the second side, the sixth side adjacent to the fifth side, forming an angle of substantially 120° therewith, the sixth side being substantially parallel to the third side and the seventh side adjacent to the sixth side, the seventh side being substantially parallel to the first side, having a length equal to or greater than the length of the hex head sides of the first predetermined length, and being displaced from the first side by a distance substantially equal to the distance between parallel sides of the square shaped head of the second predetermined length. In various embodiments of wrenches in accordance with the present invention, the angle formed by the first side and the second side may be selected from the range greater than 180° and up to 240°, such from the range greater than 250° and up to 240°. Desirably, the angle may be 240°.

BRIEF DESCRIPTION OF THE DRAWINGS

Other objects and advantages of the invention will become apparent upon reading the following detailed description and upon reference to the drawings in which:

FIG. 1 is a top view of a wrench constructed in accordance with the principles of the instant invention shown with a hex shaped head and a square shaped head;

FIG. 2 is a side view of the wrench shown in FIG. 1;

FIG. 3 is a partial top view of the drive end of a wrench constructed in accordance with the principles of the instant invention;

FIG. 4 is a partial top view of the drive end of a wrench constructed in accordance with another embodiment of the instant invention;

Figure 5:
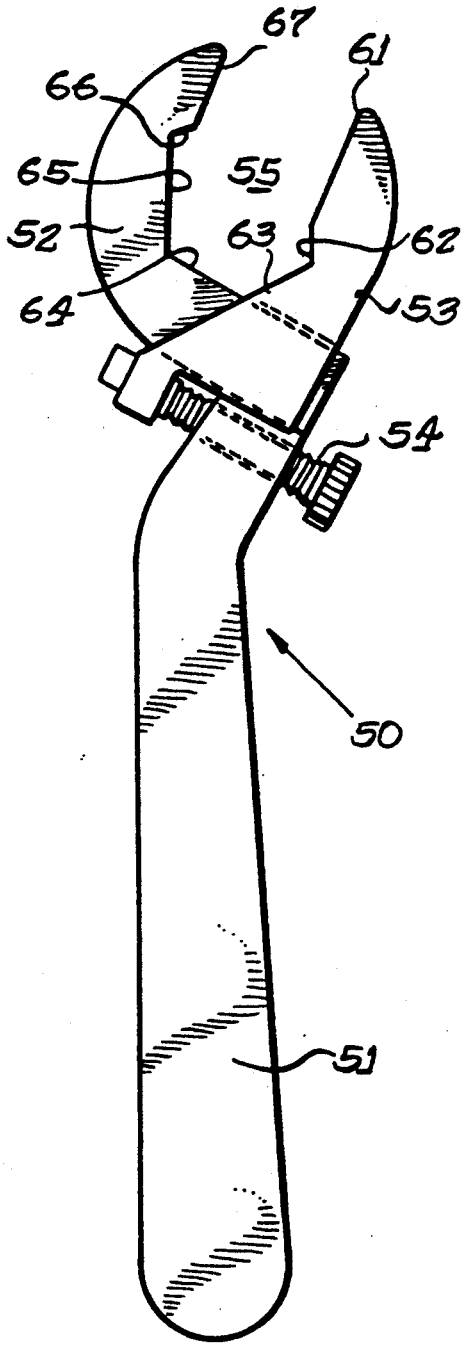
FIG. 5 is a top view of an adjustable wrench constructed in accordance with the principles of the instant invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning first to FIG. 1, wrench 10 is shown including a drive end 11 and a handle 12. Drive end 11 includes an opening 13 which allows wrench 10 to be inserted around a hex shaped head or a square shaped head of a nut, bolt, fitting or the like in order to allow turning of the item. Opening 13 is enclosed by a first side 21, a second side 22, a third side 23, a fourth side 24, a fifth side 25, a sixth side 26 and a seventh side 27. First side 21 is adjacent to second side 22 and forms angle A, as shown in FIG. 3, which is greater than 180°. Second side 22 is of a length that is shorter than the length of the hex head side of the desired hex head side to be turned by the wrench. The length of the second side should best be greater than 25% of the length of the hex head side, and should also best be less than 42% of the length of the specific hex head side which is desired to be turned by the wrench. For example, the length of the second side may be approximately 33% of the length of the particular hex head side which is to be used with the wrench. Third side 23 forms an angle of 120° with second side 22 and has a length equal to the length of hex head side desired to be turned. Fourth side 24 forms an angle of 120° with third side 23 and has a length equal to the length of hex head side desired to be turned and is equal in length to third side 23. Fifth side 25 forms an angle of 120° with fourth side 24 and is substantially parallel to second side 22. Fifth side 25 is of a length which is greater than or equal to the sum of length of the hex head side of the hex desired to be turned and the length of second side 22. Sixth side 26 forms an angle of 120° with fifth side 25 and is substantially parallel to third side 23. Seventh side 27 is substantially parallel to first side 21 and is displaced from first side 21 by a distance equal to the distance between parallel sides of the hex head or square head object which is desired to be turned. FIG. 1 shows hex head 28 which is of the size to be turned by drive end 11. It also shows a square head 29 which would be turnable by drive end 30. Drive end 11 may be used to turn either a square head or hex head having an equal distance between parallel sides equal to the distance between first side 21 and seventh side 27 or the distance between second side 22 and fifth side 25.

Drive end 30 operates similarly to drive end 11 and is shown in position to turn square head 29 in either direction without a ratcheting action.

In use, the wrench can perform as an open end wrench merely by inserting the hex head or the square head between first side 21 and seventh side 27 and turning in either direction as desired.

In use with a hex shaped bolt or nut, the hex head is inserted between first side 21 and seventh side 27 and then slid sideways so that the hex head lies firmly against second side 22, third side 23, fourth side 24 and fifth side 25. In order to drive the head, the wrench is then turned in a clockwise direction. Whenever the end of the travel is achieved by the handle, and the wrench is turned in a counter-clockwise direction, the wrench will ratchet and not drive the head. Accordingly, a user must merely move the wrench handle back and forth through whatever distance available and the wrench will automatically ratchet and drive the head in a clockwise direction as seen in FIG. 1.

It is preferred that all the sides of the wrench be flat in order to provide a positive contact with the hex side or square side of the nuts or bolts which are desired to be turned. In this manner too, stripping of the corners of the heads is minimized. As an additional feature, when a hex is turned, four corners of the hex are driven by the wrench since they will be firmly engaged by second side 22, third side 23, fourth side 24 and fifth side 25. When the wrench is turned in a counter-clockwise direction, the hex will pivot along the intersection of first side 21 and second side 22 and allow second side 22 to be inserted over the next corner of the head, which will put it in condition to drive it for the next clockwise movement of the handle.

Turning to FIG. 4, there is shown a partial top view of a wrench 35 showing another embodiment of the instant invention. It includes a handle 36 and a drive end 37. Drive end 37 has an opening 38. A hex head 39 is shown positioned in opening 38. Drive end 37 has a first side 41, a second side 42, a third side 43, a fourth side 44, a fifth side 45 and a sixth side 46. First side 41 is adjacent to second side 42 and forms an angle of 240° with second side 42. Second side 42 is of a length that is shorter than the length of the hex head side of the desired hex head side to be turned by the wrench. Third side 43 forms an angle of 120° with a second side 42 and has a length equal to the length of hex head side desired to be turned. Fourth side 44 forms an angle of 120° with third side 43 and has a length equal to the length of the hex head side desired to be turned and is equal in length to third side 43. Fifth side 45 forms an angle of 120° with fourth side 44 and is substantially parallel to second side 42. Fifth side 45 is of a length which is equal to the sum of length of the hex head side of the hex desired to be turned and the length of second side 42. Sixth side 46 forms an angle of 120° with fifth side 45 and is substantially parallel to first side 41 and is displaced from first side 41 by a distance equal to the distance between parallel sides of the hex head or square head object which is desired to be turned. In this regard, as shown in FIG. 4, it is an important feature of the wrench 35 that the hex object 39 may be subjected to a ratcheting action by the interaction of the hex object with the sides 42, 43, 44 and 45, and the same hex object may be subjected to a torquing action by placement of the object between sides 41 and 46. As shown in FIG. 4, the flat, parallel side 41, 46 is at least equal in length to the length of the sides of the hex object 39 for which the wrench 35 is designed. In the illustrated embodiment 35, the side 41 is about one and one-half times the length of internal sides 43, 44. As also shown in FIG. 4, the side 46 is longer than side 41. Sides 41 and 46 each terminate at the interception of the sides 41, 46 with the periphery of the drive end 37. Because of stress concentration at the intersection of sides 45, 46 and 43, 44, and operational rigidity considerations, the distance 49 between the point of intersection of sides 45, 46 and the outer periphery of the drive end 37 and the distance 48 between the point of intersection between sides 43, 44 and the outer periphery of the drive end 37 should desirably be at least equal to the length of side 43, and may further be at least equal to about 1.2 times the length of side 43.

FIG. 4 shows hex shaped head 39 in position to be driven in a clockwise direction while allowing wrench 35 to be ratcheted in a counter-clockwise direction. The wrenches in accordance with the present invention such as wrench 35 may desirably be formed of a chromium-vanadium steel and may have a relatively ductile hardness of about 35° HrC.

FIG. 5 shows an adjustable wrench 50 constructed in accordance with the instant invention. It includes a handle 51 and a drive end 52. Drive end 52 includes a movable portion 53 which can be adjusted by threaded member 54 to alter the size of an opening 55 in which various size square or hex headed members are inserted in order to allow turning of the head. Opening 55 is enclosed by a first side 61, a second side 62, a third side 63, a fourth side 64, a fifth side 65, a sixth side 66 and a seventh side 67. First side 61 is adjacent to second side 62 and forms an angle which is greater than 180°. Second side 62 is of a length that is shorter than the length of the hex head side of the desired hex head side to be turned by the wrench. Third side 63 forms an angle of 120° with second side 62 and had a length equal to the length of the largest hex head side desired to be turned. Fourth side 64 forms an angle of 120° with third side 63 and has a variable length depending on the size of the hex head desired to be turned. Fifth side 65 forms an angle of 120° with fourth side 64 and is substantially parallel to second side 62. Fifth side 65 is of a length which is greater than or equal to the sum of length of third side 63 and the length of second side 62. Sixth side 66 forms an angle of 120° with fifth side 65 and is substantially parallel to third side 63. Seventh side 67 is substantially parallel to first side 61 and is displaced from first side 61 by a distance which varies.

Wrench 50 will allow a square head to be turned in either direction without ratcheting by first side 61 and seventh side 67. Wrench 50 will allow a hex head to be turned in a clockwise direction while ratcheting in a counter-clockwise direction. Wrench 50 will drive a hex head with second side 62, third side 63 and fifth side 65. Fourth side 64 will drive the hex head only when fourth side 64 extends away from its intersection with third side 63 by a distance equal in length to third side 63.

Figure 6:
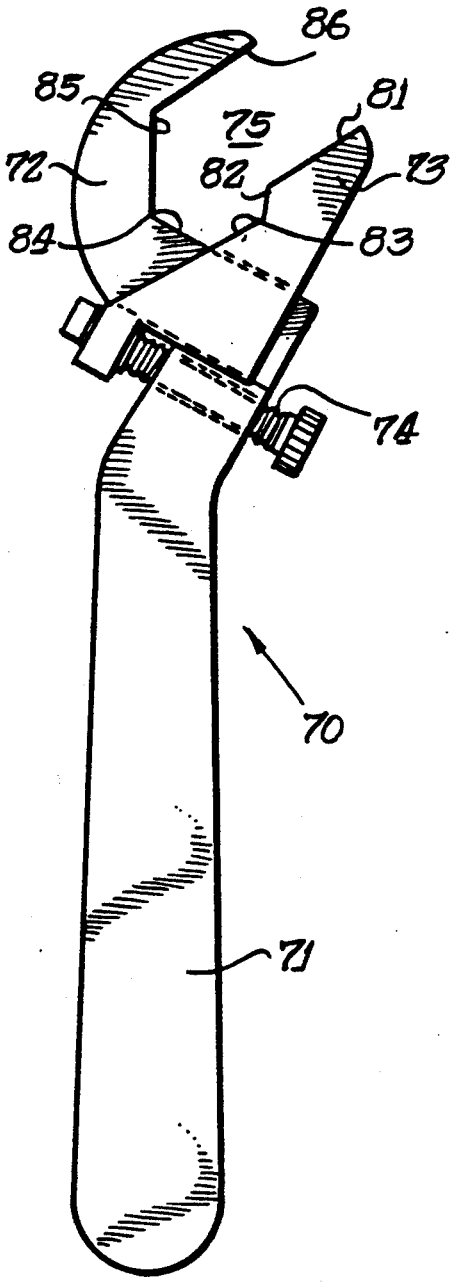
FIG. 6 is a top view of an adjustable wrench constructed in accordance with another embodiment of the principles of the instant invention.

FIG. 6 shows an adjustable wrench 70 constructed in accordance with another embodiment of the instant invention. It includes a handle 71 and a drive end 72. Drive end 72 includes a movable portion 73 which can be adjusted by threaded member 74 to alter the size of an opening 75 in which various size square or hex headed members are inserted in order to allow turning of the head. Opening 75 is enclosed by a first side 81, a second side 82, a third side 83, a fourth side 84, a fifth side 85 and a sixth side 86. First side 81 is adjacent to second side 82 and forms an angle of 240° with second side 82. Second side 82 is of a length that is shorter than the length of the hex head side of the desired hex head side to be turned by the wrench. Third side 83 forms an angle of 120° with second side 82 and has a length equal to the length of the largest hex head side desired to be turned. Fourth side 84 forms an angle of 120° with third side 83 and has a variable length depending on the size of the hex head desired to be turned. Fifth side 85 forms an angle of 120° with fourth side 84 and is substantially parallel to second side 82. Fifth side 85 is of a length which is equal to the sum of length of the third side S3 and the length of second side 82. Sixth side 86 is substantially parallel to first side 81 and is displaced from first side 81 by a distance equal to the distance between parallel sides of the hex head or square head object which is desired to be turned.

Wrench 70 will allow a square head to be turned in either direction without ratcheting by first side 81 and sixth side 86. Wrench 70 will allow a hex head to be turned in a clockwise direction while ratcheting in a counter-clockwise direction. Wrench 70 will drive a hex head with second side 82, third side 83 and fifth side 85. Fourth side 84 will drive the hex head only when fourth side 84 extends away from its intersection with third side 83 by a distance equal in length to third side 83.

Although wrench 50 does not, wrench 70 has the added versatility of turning hex heads and square heads having equal distances between their parallel sides. This versatility will only occur when fifth side 85 is equal in length to the sum of the length of third side 83 and second side 82. Additionally, a point on fifth side 85 which is the distance of second side 82 away from sixth side 86 and the distance of third side 83 away from fourth side 84 must travel back and forth upon a line which is parallel to fourth side 84 and which would intersect the intersection of second side 82 and third side 83 if extended. When these conditions occur, then an adjustable wrench 70 will have all the features of wrench 10 or wrench 35 except that fourth side 84 will not always drive the hex head.

Thus it is apparent that there has been provided, in accordance with the invention, a product that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A multiple use wrench for use with a hex shaped head with equal hex head sides of a first predetermined length and a square shaped head with equal square head sides of a second predetermined length, where the distance between parallel sides of the hex shaped head is equal to the distance between parallel sides of the square shaped head, including a handle; a drive end attached at one end of said handle; said drive end having an opening through said drive end opposite said handle and communicating with an internal unidirectional hex head driving zone, said opening and said hex head driving zone being suitable for driving said hex shaped and square shaped heads, said opening being defined by seven adjacent flat, linear sides which are connected in order from a first side to a second side to a third side to a fourth side to a fifth side to a sixth side and to a seventh side; said first side having a length suitable for driving said square shaped head; said second side adjacent to said first side and having a length less than said first predetermined length; said third side adjacent to said second side, forming an angle of substantially 1202 therewith, and having a length substantially equal to said first predetermined length; said fourth side adjacent to said third side, forming an angle of substantially 120° therewith, and having a length substantially equal to said first predetermined length;

said fifth side adjacent to said fourth side, forming an angle of substantially 120° therewith, said fifth side being substantially parallel to said second side, and having a length greater than or equal to said first predetermined length plus the length of said second side; said sixth side adjacent to said fifth side, forming an angle of substantially 120° therewith, said sixth side being substantially parallel to said third side; and said seventh side adjacent to said sixth side, said seventh side being substantially parallel to said first side, having a length equal to or greater than said first predetermined length, and being displaced from said first side by a distance substantially equal to the distance between parallel sides of said square shaped head of said second predetermined length such that said square head may be turned in either direction by means of said first and said seventh parallel sides, and wherein said hex head may be inserted through said opening formed by said first and seventh sides into said hex head driving zone and wherein said hex head may be unidirectionally driven in said hex head driving zone by contact with second, third, fourth and fifth sides.

2. A multiple use wrench as in claim 1, wherein the angle formed by said first side and said second side is selected from the range greater than 180° and up to 240°.

3. A multiple use wrench as in claim 1, wherein the angle formed by said first side and said second side is selected from the range greater than 225° and up to 240°.

4. A multiple use wrench as in claim 1, wherein the length of said second side is greater than 25% of the length of said hex head side of said first predetermined length.

5. A multiple use wrench as in claim 1, wherein the length of said second side is less than 42% of the length of said hex head side of said first predetermined length.

6. A multiple use wrench as in claim 1, wherein the length of said second side is approximately 33% of the length of said hex head side of said first predetermined length.

7. A multiple usé wrench is accordance with claim 1 wherein said wrench is formed of a chrome-vanadium steel having a hardness of about 35° HrC.

8. An adjustable multiple use wrench for use with a hex shaped head with equal hex head sides of a first predetermined length and a square shaped head with equal square head sides of a second predetermined length, where the distance between parallel sides of the hex shaped head is equal to the distance between parallel sides of the square shaped head including: a handle; a drive end attached at one end of said handle; said drive end having an opening through said drive end opposite said handle and communicating with an internal unidirectional hex head driving zone, said opening and said hex head driving zone being suitable for driving said hex shaped and square shaped heads, said opening and hex head driving zone being defined by seven adjacent flat, linear sides which are connected in order from a first side to a second side to a third side to a fourth side to a fifth side to a sixth side and to a seventh side; said first side having a length suitable for driving said square shaped head; said second side adjacent to said first side and having a length less than said first predetermined length; said third side adjacent to said second side, forming an angle of substantially 120° therewith, and having a length substantially equal to said first predetermined length; said fourth side adjacent to said third side, and forming an angle of substantially 120° therewith; said fifth side adjacent to said fourth side forming an angle of substantially 120° therewith, said fifth side being substantially parallel to said second side, and having a length greater than or equal to the length of said first predetermined length plus the length of said second side; said sixth side adjacent to said fifth side, forming an angle of substantially 120° therewith, said sixth side being substantially parallel to said third side; and said seventh side adjacent to said sixth side, said seventh side being substantially parallel to said first side, having a length equal to or greater than the length of said first predetermined length, and being variably displaceable from said first side by an adjustment means such that said square head may be turned in either direction by means of said first and said seventh parallel sides, and wherein said hex head may be inserted through said opening formed by said first and seventh sides into said hex head driving zone and wherein said hex head may be unidirectionally driven in said hex head driving zone by contact with said second, third, fourth and fifth sides.

9. An adjustable multiple use wrench as in claim 8, wherein said adjustment means includes a movable portion and a threaded member which can fixedly adjust the position of said movable portion.

10. An adjustable multiple use wrench as in claim 9 wherein said movable portion includes said first side, said second side and said third side and said movable portion is slidably attached to said drive end so as to allow movement in a direction parallel to said fourth side.

11. A multiple use wrench for use with a hex shaped head with equal hex head sides of a first predetermined length and a square shaped head with equal square head sides of a second predetermined length, where the distance between parallel sides of the hex shaped head is equal to the distance between parallel sides of the square shaped head, including: a handle; a drive end attached to one end of said handle; said drive end having an opening through said drive end opposite said handle and communicating with an internal unidirectional hex head driving zone, said opening and said hex head driving zone being suitable for driving said hex shaped and square shaped heads, said opening being defined by six adjacent flat, linear sides which are connected in order from a first side to a second side to a third side to a fourth side to a fifth side and to a sixth side; said first side having a length suitable for driving said square shaped head; said second side adjacent to said first side, forming an angle of substantially 240° therewith, and having a length less than said first predetermined length; said third side adjacent to said second side, forming an angle of substantially 120° therewith, and having a length substantially equal to said first predetermined length; said fourth side adjacent to said third side, forming an angle of substantially 120° therewith, and having a length substantially equal to said first predetermined length; said fifth side adjacent to said fourth side, forming an angle of substantially 120° therewith, said fifth side being substantially parallel to said second side, and having a length greater than or equal to said first predetermined length plus the length of said second side; said sixth side adjacent to said fifth side, forming an angle of substantially 120° therewith, said sixth side being substantially parallel to said first side and said third side; and having a length of substantially said first predetermined length plus the length of said first side, and being displaced from said first side by a distance substantially equal to the distance between parallel sides of said square shaped head of said second predetermined length such that said square head may be turned in either direction by means of said first and said sixth parallel sides, and wherein sad hex head may be inserted through said opening formed by said first and sixth sides into said hex head driving zone and wherein said hex head may be unidirectionally driven in said hex head driving zone by contact with said second, third, fourth and fifth sides.

12. A multiple use wrench in accordance with claim 11 wherein the distance between the point of intersection of said third side and said fourth side with the outer periphery of said drive end and the distance between the point of intersection between said fifth side and said sixth side and the outer periphery of said drive end are each at least equal to about 1.2 times said first predetermined length.

* * * * *